US009968814B2

(12) United States Patent
Miller et al.

(10) Patent No.: US 9,968,814 B2
(45) Date of Patent: May 15, 2018

(54) MULTIPURPOSE FITNESS APPARATUS AND METHOD FOR ASSEMBLY

(71) Applicant: XYSTUS, LLC, Carrollton, TX (US)

(72) Inventors: Reuben A. Miller, McKinney, TX (US); Shane Hernandez, McKinney, TX (US)

(73) Assignee: XYSTUS, LLC, Carrollton, TX (US)

( * ) Notice: Subject to any disclaimer, the term of this patent is extended or adjusted under 35 U.S.C. 154(b) by 44 days.

(21) Appl. No.: 15/277,526

(22) Filed: Sep. 27, 2016

(65) Prior Publication Data

US 2017/0080271 A1 Mar. 23, 2017

Related U.S. Application Data

(63) Continuation-in-part of application No. 14/684,626, filed on Apr. 13, 2015, now Pat. No. 9,649,521.
(Continued)

(51) Int. Cl.
*A63B 5/20* (2006.01)
*A63B 21/00* (2006.01)
(Continued)

(52) U.S. Cl.
CPC ..... *A63B 21/00* (2013.01); *A63B 21/00043* (2013.01); *A63B 21/00185* (2013.01);
(Continued)

(58) Field of Classification Search
CPC ..... A63B 5/20; A63B 17/00; A63B 17/02; A63B 17/04; A63B 21/0004; A63B 21/00043; A63B 21/0552; A63B 21/015; A63B 21/00185; A63B 21/4049; A63B 22/0046; A63B 22/20; A63B 22/201; A63B 22/203; A63B 23/02; A63B 23/0205; A63B 23/0211; A63B 23/03525; A63B 2210/50; A63B 71/0036; A63B 2210/00; A63B 2210/58; A63B 21/4033; A63B 21/4035; A61H 2015/0014; A61H 2015/0021; A61H 2015/0028; A61H 2015/0035;
(Continued)

(56) References Cited

U.S. PATENT DOCUMENTS 3,298,687 A * 1/1967 Douglas ..... A61H 15/0092 482/122
3,415,515 A * 12/1968 Otto ..... A63B 5/20 482/129
(Continued)

*Primary Examiner* — Joshua Lee
(74) *Attorney, Agent, or Firm* — Stephen Y. Liu; Colin P. Cahoon; Carstens & Cahoon, LLP

(57) ABSTRACT

A fitness apparatus and a method for assembly are disclosed. The fitness apparatus comprises a wheel assembly that includes a first circular side parallel to a second circular side, both bounded by a curved tread. Within the wheel assembly is an enclosable storage chamber. The fitness apparatus also includes an axis perpendicular to the first circular side and the second circular side, and when the fitness apparatus is in an abdominal exercise wheel configuration, at least a portion of the wheel assembly rotates around the axis. The fitness apparatus also includes a centerbore along the axis that supports a first removable handle and a second removable handle when the fitness apparatus is in the abdominal exercise wheel configuration.

19 Claims, 14 Drawing Sheets

Related U.S. Application Data

(60) Provisional application No. 62/000,344, filed on May 19, 2014.

(51) Int. Cl.

| | |
|---|---|
| ***A63B 23/02*** | (2006.01) |
| ***A63B 22/20*** | (2006.01) |
| ***A63B 21/068*** | (2006.01) |
| ***A63B 71/00*** | (2006.01) |
| ***A63B 23/035*** | (2006.01) |
| *A63B 21/055* | (2006.01) |
| *A61H 15/00* | (2006.01) |
| *A63B 22/00* | (2006.01) |
| *A63B 23/00* | (2006.01) |
| *A63B 69/06* | (2006.01) |
| *A63B 21/012* | (2006.01) |
| *A63B 21/04* | (2006.01) |
| *A63B 21/16* | (2006.01) |

(52) U.S. Cl.

CPC ..... *A63B 21/068* (2013.01); *A63B 21/4035* (2015.10); *A63B 22/20* (2013.01); *A63B 23/0211* (2013.01); *A63B 23/03525* (2013.01); *A63B 71/0036* (2013.01); *A61H 15/0092* (2013.01); *A61H 2015/0014* (2013.01); *A61H 2201/0107* (2013.01); *A61H 2201/0153* (2013.01); *A61H 2201/0157* (2013.01); *A61H 2201/0161* (2013.01); *A63B 5/20* (2013.01); *A63B 21/0004* (2013.01); *A63B 21/012* (2013.01); *A63B 21/0442* (2013.01); *A63B 21/0552* (2013.01); *A63B 21/1645* (2013.01); *A63B 21/4013* (2015.10); *A63B 21/4034* (2015.10); *A63B 21/4039* (2015.10); *A63B 21/4049* (2015.10); *A63B 23/0216* (2013.01); *A63B 23/03541* (2013.01); *A63B 69/06* (2013.01); *A63B 2022/0035* (2013.01); *A63B 2022/0038* (2013.01); *A63B 2022/0041* (2013.01); *A63B 2023/006* (2013.01); *A63B 2209/08* (2013.01); *A63B 2209/10* (2013.01); *A63B 2210/50* (2013.01); *A63B 2210/58* (2013.01)

(58) Field of Classification Search

CPC ..... A61H 2015/0057; A61H 15/0092; A61H 2201/1253

See application file for complete search history.

(56) References Cited

U.S. PATENT DOCUMENTS 3,428,015 A * 2/1969 Cloud ..... A63B 19/02 280/206
3,905,617 A * 9/1975 Smith ..... A63B 19/02 280/206
4,339,126 A * 7/1982 Marletta ..... A63B 22/20 482/132
4,364,579 A * 12/1982 Fisher ..... A63B 19/02 280/206
4,431,185 A * 2/1984 Cisneros ..... A63B 21/072 220/318
4,722,523 A * 2/1988 Yang ..... A63B 17/04 482/106
5,637,065 A * 6/1997 Chang ..... A63B 23/14 482/1
5,707,325 A * 1/1998 Chiou ..... A63B 22/20 482/127
6,419,650 B1 * 7/2002 Ryan ..... A61H 15/00 601/122
7,175,573 B1 * 2/2007 Huang ..... A63B 21/0004 446/236
8,382,645 B2 * 2/2013 Mylrea ..... A63B 21/0004 482/148
8,894,555 B2 * 11/2014 Colledge ..... A63B 21/0004 482/118
9,005,088 B2 * 4/2015 Sides, Jr. ..... A63B 21/0618 482/106
9,352,184 B2 * 5/2016 Davis ..... A63B 21/0552
2002/0123416 A1 * 9/2002 Huang ..... A63B 21/153 482/140
2005/0059532 A1 * 3/2005 Huang ..... A63B 5/20 482/82
2008/0167168 A1 * 7/2008 Hurst ..... A63B 21/0728 482/132
2008/0179214 A1 * 7/2008 Hall ..... A63B 71/0036 206/579
2008/0200851 A1 * 8/2008 Faussett ..... A61H 15/0092 601/119
2011/0183824 A1 * 7/2011 Yang ..... A63B 21/0004 482/132
2011/0183825 A1 * 7/2011 Yang ..... A63B 21/4039 482/132
2011/0300995 A1 * 12/2011 Castiglione ..... A61H 15/0092 482/51
2012/0065557 A1 * 3/2012 Phillips ..... A61H 15/0092 601/99
2012/0077650 A1 * 3/2012 Amstler ..... A63B 21/0125 482/114
2012/0157274 A1 * 6/2012 MacColl ..... A63B 21/0004 482/132
2012/0172184 A1 * 7/2012 Wang ..... A63B 21/0552 482/132
2012/0264578 A1 * 10/2012 Frederick ..... A63B 21/0004 482/132
2012/0309599 A1 * 12/2012 Miller, Jr. ..... A63B 22/20 482/139
2013/0138024 A1 * 5/2013 Jennings ..... A61H 15/0092 601/119
2013/0178768 A1 * 7/2013 Dalebout ..... A61H 15/0092 601/46
2013/0310234 A1 * 11/2013 Miller, Jr. ..... A63B 22/20 482/139
2014/0128786 A1 * 5/2014 Ross ..... A61H 15/0092 601/118
2014/0342883 A1 * 11/2014 Joost ..... A63B 21/0442 482/129
2015/0209220 A1 * 7/2015 Lin ..... A61H 15/0092 601/119
2016/0101314 A1 * 4/2016 Exley ..... A63B 22/20 482/132

* cited by examiner

MULTIPURPOSE FITNESS APPARATUS AND METHOD FOR ASSEMBLY

CROSS-REFERENCE TO RELATED APPLICATION

This nonprovisional application claims priority to and relies on U.S. Non-Provisional patent application Ser. No. 14/684,626, filed Apr. 13, 2015, entitled "MULTIPURPOSE FITNESS APPARATUS AND METHOD FOR ASSEMBLY," which claims priority to U.S. Provisional Patent Application Ser. No. 62/000,344, filed May 19, 2014, both of which are incorporated by reference in its entirety.

TECHNICAL FIELD

The present invention relates to an apparatus for a compact, multi-purpose fitness device having an abdominal exercise wheel configuration in one aspect, and a method for assembling and disassembling the same.

DESCRIPTION OF RELATED ART

A pervading theme in American society is health and wellness, one such component of which is fitness. Fit people are less likely to be obese, which reduces the risk being afflicted with a number of health-related maladies, such as heart disease, stroke, high blood pressure, and diabetes. Studies have shown a number of psychological and cognitive benefits as well. As a result, fit people also tend to live longer.

Exercising promotes fitness. Currently, the Centers for Disease Control and Prevention recommends that adults strive for at least 150 minutes of moderate-intensity aerobic activity and muscle-strengthening activities each week. Many Americans fall woefully short. As people age, lifestyles tend to become more sedentary. School activities and hobbies are replaced by long commutes and jobs that may require hours spent seated in front of a computer monitor. After school sports and extracurricular activities are replaced by evenings in front of a television, and nights out in restaurants and bars. Decreased activity levels may also be the result of a lack of access to fitness equipment. Home gyms require a large capital investment, and oftentimes trips to the local gym require more of a daily time investment than is available. In addition, employees that travel for work may not be geographically proximate to a workout facility.

BRIEF SUMMARY OF THE INVENTION

At least one solution to the aforementioned problems is a fitness apparatus that is relatively inexpensive, easy to use, easy to store, and provides a variety of proven, time-tested exercises. To this end, Applicant has devised a novel way of incorporating various pieces of fitness equipment into a form factor characterized by portability, storability, and usability.

In accordance with a first embodiment, a wheel assembly is provided for a fitness apparatus. The wheel assembly includes a rim and a curved tread surface rotatably engaged around the rim. A reinforced connection, which is engaged with an interior surface of the rim, houses a set of handlebar connectors. The wheel assembly has a substantially cylindrical shape with a first circular side separated from a second circular side by the rim.

In accordance with a second embodiment, a fitness apparatus is provided which includes a pair of handles and a wheel assembly attached to the set of handles. The wheel assembly further includes a rim with a substantially cylindrical shape characterized by a first circular side and a second circular side opposite and parallel to the first circular side. A curved tread surface is rotatably engaged around the rim and a reinforced connection is engaged with an interior surface of the rim. The reinforced connection houses a set of handlebar connectors.

BRIEF DESCRIPTION OF THE DRAWINGS

The novel features believed characteristic of the invention are set forth in the appended claims. The invention itself, however, as well as a preferred mode of use, further objectives and advantages thereof, will be best understood by reference to the following detailed description of illustrative embodiments when read in conjunction with the accompanying drawings, wherein:

DETAILED DESCRIPTION

Several embodiments of Applicant's invention will now be described with reference to the drawings. Unless otherwise noted, like elements will be identified by identical numbers throughout all or at least a subset of figures.

Figure 1:
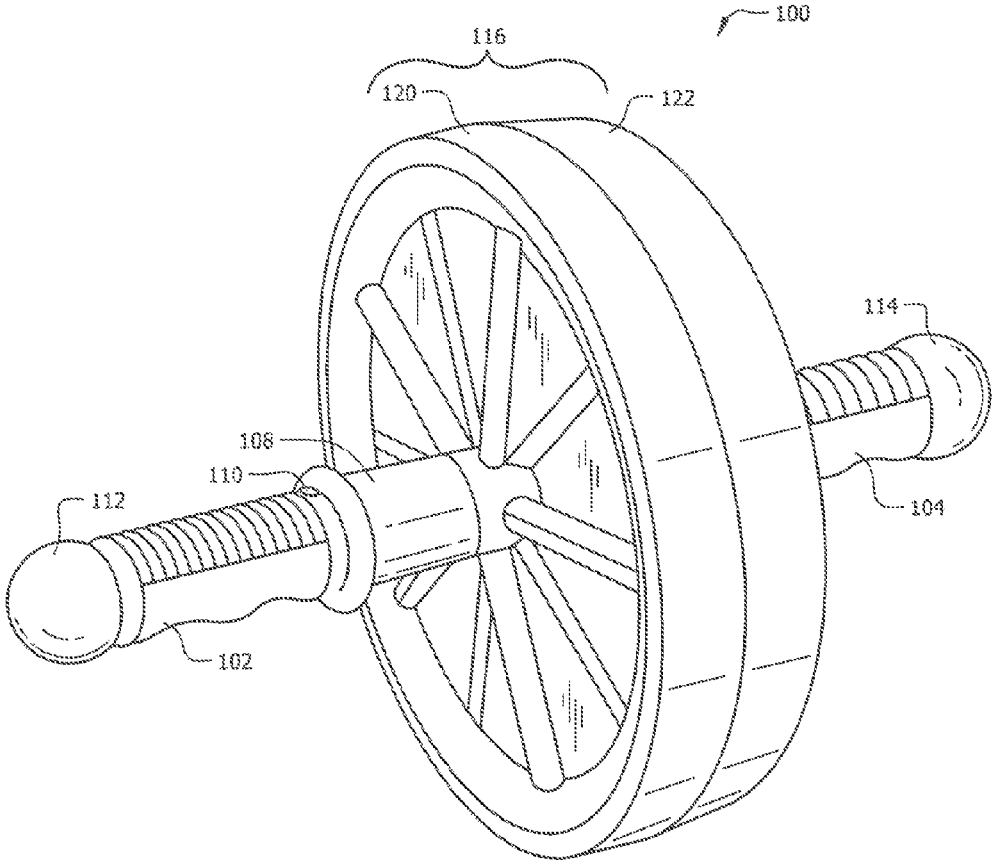
FIG. 1 is a perspective view of the fitness apparatus in accordance with an illustrative embodiment.

FIG. 1 is a perspective view of the fitness apparatus in accordance with an illustrative embodiment. In particular, fitness apparatus 100 is depicted in the assembled configuration which may also be referred to herein as the abdominal exercise wheel configuration. Fitness apparatus 100 can be generally described as a shaft with opposing handles on each end and a wheel assembly located between the handles and rotatably engaged around the shaft. In particular, handles 102 and 104 are removably engaged to opposite ends of shaft 106 (shown in FIG. 2), and foam roller 108 is rotatably engaged around an outer surface of shaft 106, between handles 102 and 104. Also located between handles 102 and 104 is wheel assembly 116, which is also configured to rotate around shaft 106.

Foam roller 108 is a hollow cylindrical component that has a soft outer surface selected of a material that can be used to comfortably engage a user's body for serving as a massage bar. In a non-limiting embodiment, the outer surface of foam roller 108 is made of a soft and spongy foam; however, alternate embodiments may have an outer surface formed from material having similar characteristics. The inside surface of foam roller 108, which engages the outer surface of shaft 106, has a coefficient of friction that allows foam roller 108 to easily rotate around the outer surface of shaft 106.

In the illustrative example in FIG. 1, foam roller 108 is secured to shaft 106 by handles 102 and 104 which act similar to bookends. Removal of handle 104, for example, would allow foam roller 108 to be removed from shaft 106. This configuration that permits easy disassembly that facilitates cleaning and maintenance of fitness apparatus 100. However, in an alternate embodiment, foam roller 108 may be permanently positioned on shaft 106 by a pair of guides (not shown) protruding from shaft 106 and located on each end of foam roller 108 that prevents lateral movement of foam roller 108 on shaft 106.

As already mentioned, pair of handles 102 and 104 is removably engaged to opposite ends of shaft 106. Pair of handles 102 and 104 may be attached to shaft 106 using any currently existing or later developed attachment mechanism. For example, in a non-limiting example, handles 102 and 104 may be include female threading and shaft 106 may include male threading so that the handles 102 and 104 may be screwed onto shaft 106. As used herein, the term threaded and counter-threaded may be substituted to emphasize the generality of the attachment mechanism and that any combination of threading may be implemented that permits the attachment of handles 102 and 104 to shaft 106. However, in the illustrative embodiment depicted in FIG. 1, pair of handles 102 and 104 is attached to shaft 106 using a quick-release mechanism that allows handles 102 and 104 to be removed from shaft 106 when set of protrusions 110 is depressed. Additional detail regarding the operation of set of protrusions 110 will be provided with respect to the discussion of FIGS. 3 and 4.

Pair of handles 102 and 104 is configured with a rounded endcaps 112 and 114, respectively. Rounded endcaps 112 and 114 are sized and shaped to serve as a tool for engaging muscle trigger points. In one example, handle 102 and rounded endcap 112 are removed from shaft 106, permitting a user to grasp handle 102 such that rounded endcap 112 may be used to massage a muscle. In another example, additional leverage may be obtained by causing rounded endcap 112 to engage a muscle while handle 102 is still attached to shaft 106 and fitness apparatus 100 is in the massage bar configuration.

Wheel assembly 116 is a wheel-shaped component having a centerbore 118 (depicted in FIG. 2) that forms a passage from a first lateral side of wheel assembly 116 to a second lateral side of wheel assembly 116. In the abdominal exercise wheel configuration, centerbore 118 is designed to receive foam roller 108, which is in turn rotatably engaged around shaft 106. Additionally, centerbore 118 is sized so that wheel assembly 116 snugly engages the outer surface of foam roller 108 when in the abdominal exercise wheel configuration. Thus the rotation of foam roller 108 around shaft 106 also allows wheel assembly 116 to rotate around an axis formed by shaft 106. Restated, in the illustrative embodiment of FIG. 1, wheel assembly 116 rotates relative to shaft 106 but does not rotate relative to foam roller 108.

Wheel assembly 116 depicted in FIG. 1 is formed from first component 120 and second component 122 joined together. The first and second components 120 and 122 may be joined together using any currently existing or later developed means. For example, first component 120 may be threaded and second component 122 may be counter-threaded so that the two parts can be screwed together to form wheel assembly 116. Separating first component 120 from second component 122 exposes a chamber (shown in FIG. 2) within wheel assembly 116. Although wheel assembly 116 depicted in this non-limiting embodiment is formed from two substantially equivalent halves, in an alternate embodiment, first component 120 and second component 122 may have unequal or disproportionate sizes. For example, first component 120 may include a first lateral side of wheel assembly 116 and also the entirety of the curved tread surface that engages a floor. Second component 122 would then comprise only a second lateral side, or a portion of the second lateral side of wheel assembly 116. Thus, in this alternate embodiment, the second lateral side may form a detachable cover permitting access to the chamber within.

The outer, curved portion of first component 120 and second component 122 form a curved tread surface that engages an exercising surface. The curved tread surface may be formed from a material that is capable of frictionally engaging a flooring surface upon which fitness apparatus 100 is being used. Thus, the outer portion of the curved tread surface may be formed from rubber, or a rubber-like product that can be used equally well on carpet, hardwood, tile, or other flooring material. In the alternative or in addition, the outer portion of the curved tread surface may include features, such as tread marks in any number of different configurations, which promote adhesion of the curved tread surface on the flooring material.

Figure 2:
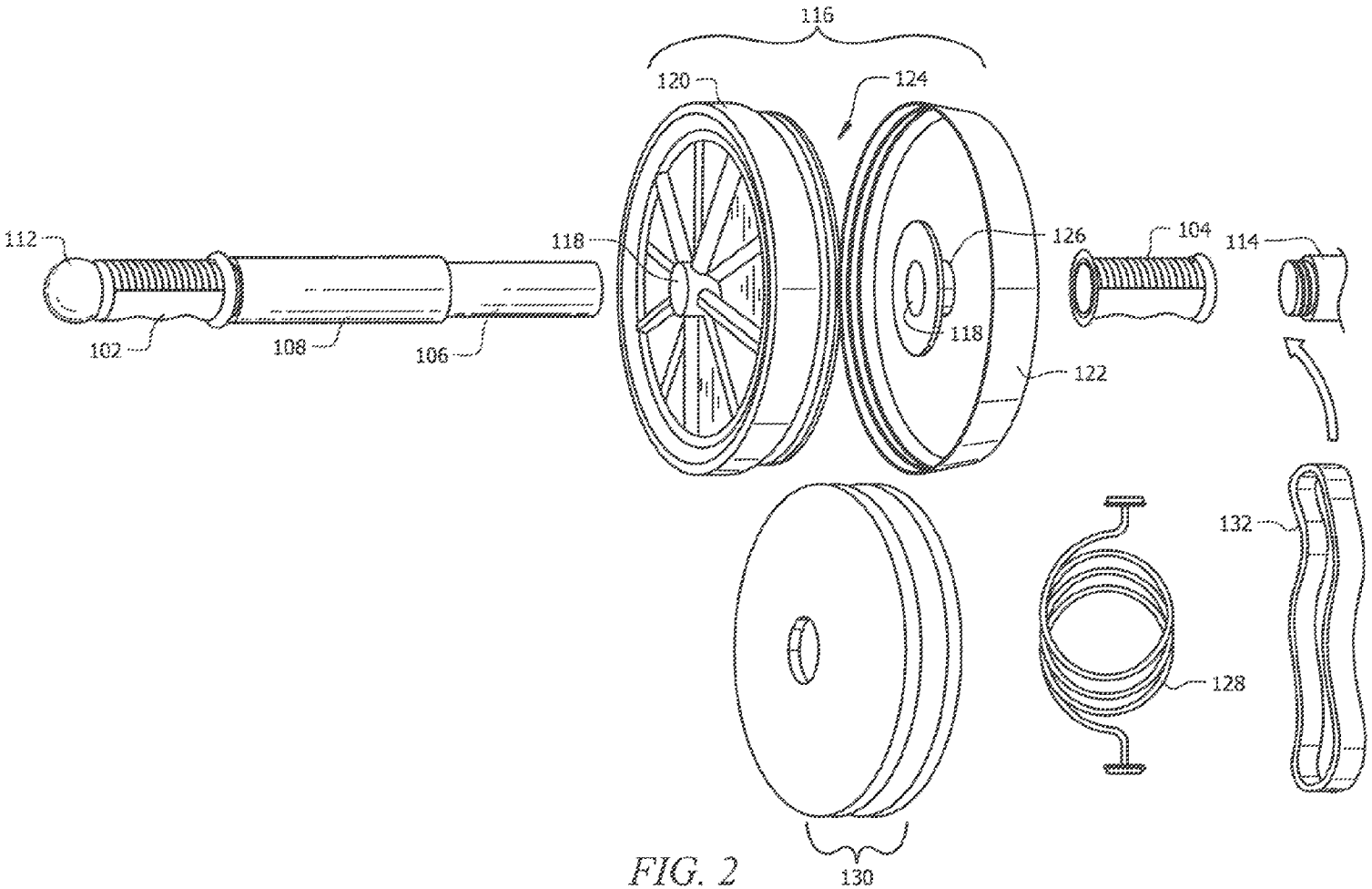
FIG. 2 is an expanded view of the fitness apparatus in accordance with an illustrative embodiment.

FIG. 2 is an exploded view of the components that form fitness apparatus 100. Handle 102, which is depicted as attached to shaft 106, includes rounded endcap 112. Foam roller 108 is placed around shaft 106 and positioned against handle 102. The inside diameter of foam roller 108 is sized slightly larger than the outer diameter of shaft 106 so that it can easily rotate around shaft 106. Furthermore, foam roller 108 may be slidably disengaged from shaft 106 by moving it laterally in a direction opposite of handle 104.

First component 120 and second component 122 of wheel assembly 116 are shown separately to depict storage chamber 124 located within wheel assembly 116. In this illustrative embodiment in FIG. 2, first component 120 and second component 122 are depicted with opposing threads so that they can be screwed together to form wheel assembly 116. In addition, within storage chamber 124 is spindle 126, which is shown attached to second component 122, projecting outwardly from an interior surface of second component 122. Spindle 126 is positioned so that centerbore 118 can pass from a first lateral side of first component 120 to the opposite lateral side of second component 122 through spindle 126 when the two components of wheel assembly 116 are joined. Spindle 126 is sized, in part, to accommodate rope 128. Thus, the height of spindle 126 is sufficient to accommodate the entire length of rope 128 when in the coiled arrangement within storage chamber 124.

Spindle 126 of FIG. 2 is depicted with a flange. The flange provides a convenient means of compartmentalizing storage chamber 124. For example, rope 124 may be stored in the part of storage chamber 124 located beneath the flange. In addition, set of sliders 130 may be stored within storage chamber 124 in the part above the flange. Set of sliders 130 is one or more disc-shaped pieces of exercise equipment that reduces friction and facilitates exercise routines that rely on body weight. In a non-limiting embodiment, a first side of set of sliders 130 has a surface adapted for engaging a carpeted floor. The opposite side may be adapted for engaging a hard flooring surface, such as tile or hardwood. At the center of set of sliders 130 is a hole that aligns with centerbore 118 of wheel assembly 116 for accommodating shaft 106. Consequently, when set of sliders 130 are placed within storage chamber 124 and properly aligned, shaft 106 and foam roller 108 may pass at least partially through centerbore 118 to form the abdominal exercise wheel configuration.

Detached handle 104 shown in FIG. 2 is depicted with the endcap 114 removed, exposing a chamber located therein. Resistance band 132 may be stored within the chamber located inside handle 104. In this illustrative embodiment, endcap 114 and handle 104 are counter-threaded so that endcap 114 can be screwed on to handle 104. However, in alternate embodiments, other attachment means may be implemented. Although resistance band 132 is depicted as being stored within the chamber of handle 104, resistance band 132 may also be stored within storage chamber 124.

To assemble fitness apparatus 100 from the constituent parts shown in FIG. 2, the following general steps may be taken. Storage cavities provided within fitness apparatus 100 should be packed. For example, one or more resistance bands may be packed within handles 102 and 104 and the corresponding endcaps replaced. Rope 128 may be wound around spindle 126, and set of sliders 130 placed within storage chamber 124 so that centerbore 118 is unobstructed. Thereafter, first component 120 and second component 122 are screwed together to form wheel assembly 116.

A handle, such as handle 102 may be affixed to shaft 106. Foam roller 108 can then be positioned on shaft 106 buttressed against handle 102. Shaft 106 and foam roller 108 may then be introduced into centerbore 118 of wheel assembly 116 and positioned such that wheel assembly 116 is located substantially centrally on shaft 106 and foam roller 108. The remaining handle may then be attached to shaft 106, forming the abdominal exercise wheel configuration of fitness apparatus 100.

Figure 3:
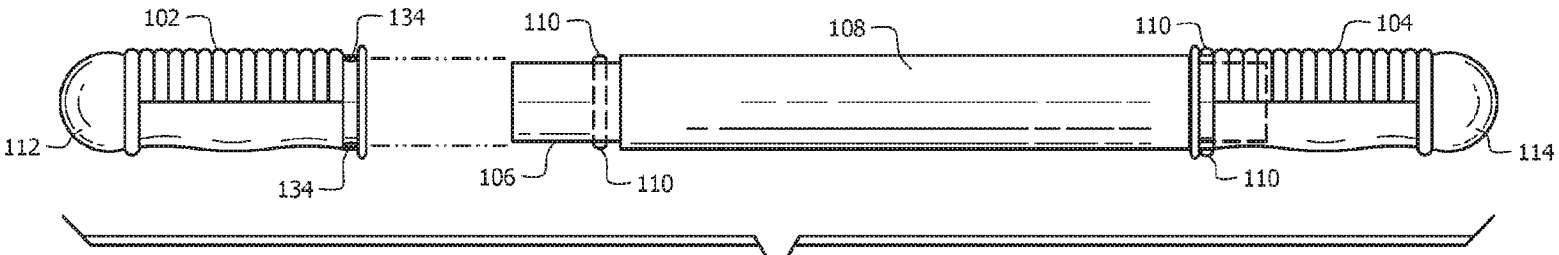
FIG. 3 is a perspective view of a massage bar that can be formed using the component parts of the fitness apparatus.

FIG. 3 is a perspective view of fitness apparatus 100 in a massage bar configuration, which comprises pair of handles 102 and 104 on opposing ends of shaft 106 and foam roller 108 located in between. In this example of FIG. 3, handle 102 is shown as detached from shaft 106 to illustrate the operation of a quick release mechanism for attaching handle 102 to shaft 106. In particular, set of projections 110 are provided which protrude from a surface of shaft 106 and align with anchor holes 134 in handles 102. Depressing set of projections 110 so that the upper surface of set of projections 110 is substantially flush with shaft 106 enables the removal of handles 102 and 104 from shaft 106. Likewise, handle 102 can be reattached to shaft 106 by depressing set of projections 110 while handle 102 is advanced partway down shaft 106 until set of projections 110 occupy anchor holes 134.

Figure 4:
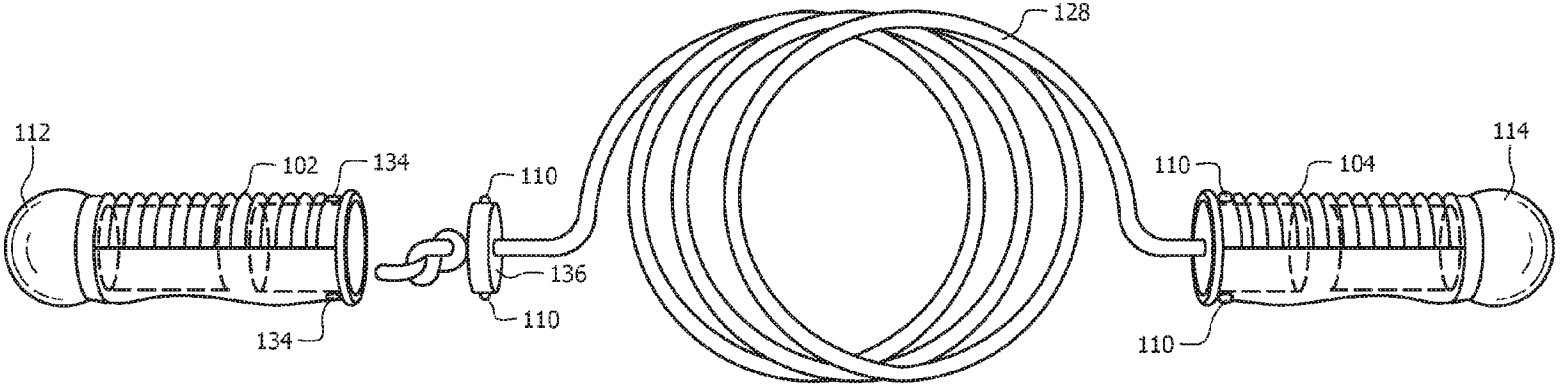
FIG. 4 is an example of a jump rope that can be formed using the parts of the fitness apparatus.

FIG. 4 is an illustrative embodiment depicting fitness apparatus 100 in the jump rope configuration. Jump rope 400 is formed from rope 128, which may be provided with a locking disc 136 on each end. Each of the locking discs 136 includes set of projections 110 that operate in the same manner as described with respect to FIG. 3. Specifically, the set of projections 110 engage anchor holes 134 within handles 102 and 104, providing a universal means of connection so that handles 102 and 104 can be used to achieve both the ab wheel configuration and jump rope configuration of fitness apparatus 100. Locking discs 136 may be temporarily or permanently affixed to the ends of rope 128 and sized to fit within handles 102 and 104. In the example depicted in FIG. 4, locking discs 136 are removably attached to rope 128 by threading and end of rope 128 through a hole in locking disc 136 and tying a simple knot at the end.

To reduce the number of constituent parts of fitness apparatus 100, locking discs 136 of FIG. 4 may be extracted from shaft 106 and attached to the ends of rope 128 to engage handles 102 and 104 every time the jump rope is used. However, in alternate embodiments, rope 128 and shaft 106 may each be provided with a pair of locking discs 136.

Figure 5:
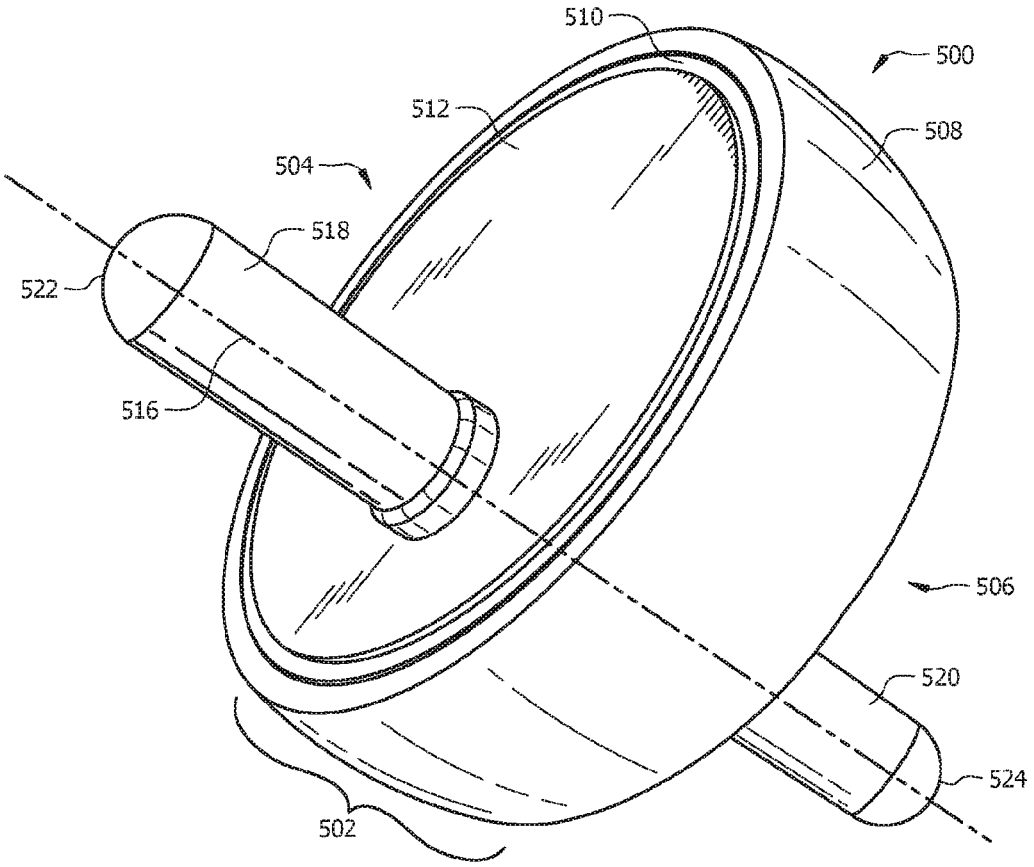
FIG. 5 is a perspective view of the fitness apparatus in accordance with a second illustrative embodiment.

FIG. 5 is a perspective view of the fitness apparatus in an abdominal exercise wheel configuration in accordance with a second illustrative embodiment. Fitness apparatus 500 can be generally described as an abdominal exercise wheel formed from a wheel assembly having a pair of handles projecting perpendicularly from each side.

With particular reference to FIG. 5, fitness apparatus 500 includes wheel assembly 502 that has first circular side 504 and second circular side 506 opposite and parallel to first circular side 504. Around a perimeter of both first circular side 504 and second circular side 506 is curved tread surface 508 engaged around an outer surface of rim 510. In addition, affixed to at least one side of wheel assembly 502 is a removable cover that can be disengaged from fitness apparatus 500 to expose a storage chamber therein. In the illustrative example of FIG. 5, removable cover 512 is removably attached to first circular side 504. Removing removable cover 512 exposes storage cavity 526, which is depicted in more detail in FIG. 6.

Fitness apparatus 500 also includes a pair of handles that extend perpendicularly from each of the circular faces along axis 516. Specifically, removable handle 518 extends outwardly from the first circular side 504, and removable handle 520 extends outwardly from second circular side 506. Each removable handle includes a rounded endcap that can be used for massage therapy. Thus, removable handle 518 includes rounded endcap 522 and removable handle 520 includes rounded endcap 524.

In the illustrative embodiment of FIG. 5, curved tread surface 508 is rotatably engaged around an outer surface of rim 510. Rotation of curved tread surface 508 around rim 510 can be achieved by any currently existing or later developed means. For example, in one non-limiting embodiment, a plurality of ball bearings may be placed between the outer surface of rim 510 and the inner surface of curved tread surface 508 to facilitate movement of the two surfaces relative to one another. In another embodiment lacking the use of ball bearings, the outer surface of rim 510 and the inner surface of curved tread surface 508 may be formed from materials having a coefficient of friction that permits curved tread surface 508 to rotate freely around rim 510. An optional lubricant can also be placed between the two surfaces to promote unimpeded movement.

The outer portion of curved tread surface 508 may be formed from a material that is capable of frictionally engaging a flooring surface upon which fitness apparatus 500 is being used. Thus, the outer portion of curved tread surface 508 may be formed from rubber, or a rubber-like product that can be used equally well on carpet, hardwood, tile, or other flooring material. In the alternative or in addition, the outer portion of curved tread surface 508 may include features, such as tread marks in any number of different configurations, which promote adhesion of curved tread surface 508 on the flooring material. For example, the tread marks may be in the form of split treads that separate curved tread surface 508 into a right side and a left side.

During operation, at least a part of wheel assembly 502 rotates around axis 516, and also pair of removable handles 518 and 520 which are located along axis 516. In particular, and consistent with the embodiment depicted in FIG. 5, the operation of fitness apparatus 500 causes curved tread surface 508 to rotate around rim 510, thus allowing pair of handles 518 and 520 and rim 510 to remain stationary relative to curved tread surface 508.

Figure 6:
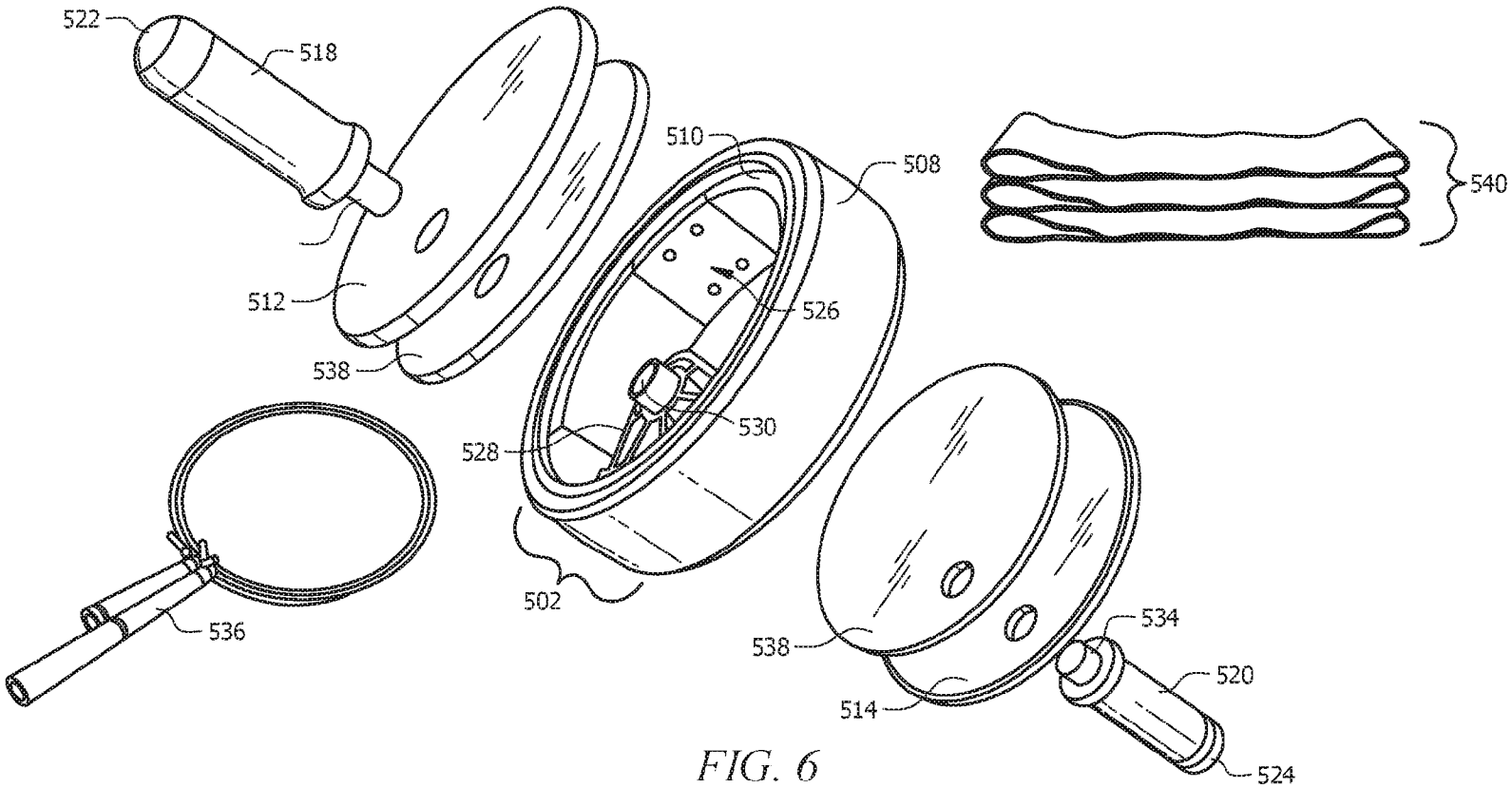
FIG. 6 is an expanded view of the fitness apparatus in accordance with the second illustrative embodiment.

FIG. 6 is an expanded view of fitness apparatus 500 depicted in FIG. 5. Removable handle 518 and removable handle 520 are shown separated from wheel assembly 502, which permits separation of removable covers 512 and 514 from wheel assembly 502 to expose storage chamber 526.

As already mentioned, wheel assembly 502 is a wheel-shaped component of fitness apparatus 500 which includes curved tread surface 508 that is rotatably engaged around rim 510. Affixed to an inner surface of rim 510 is reinforced connection 528 that projects radially inward and has a cross-sectional shape that can be generally described as triangular. However, in alternate embodiments reinforced connection 528 may have a different cross-section shape, such as a circle. Further, in this non-limiting example of FIG. 6, reinforced connection 528 includes centerbore 530 that passes from a first lateral side of reinforced connection 528 to a second lateral side. In an alternate embodiment, rather than passing entirely through reinforced connection 528, centerbore 530 is one of two cavities, one passing partially through the first side of reinforced connection 528 and the other passing partially through the second side of reinforced connection 528 to accommodate at least a part of removable handle 518 and removable handle 520, respectively.

Wheel assembly 502 includes a pair of removable covers, removable cover 512 and removable cover 514. The pair of removable covers 512 and 514 can be attached to the first and second circular sides 504 and 506 of wheel assembly 502 to enclose storage chamber 526. In addition, removable cover 512 and 514 each include a hole that extends centerbore 530 and allows the pair of removable handles 518 and 520 to be inserted within centerbore 530 when removable covers 512 and 514 are attached to wheel assembly 502.

Each of the handles that form the pair of removable handles 518 and 520 include rounded endcaps 522 and 524. In addition, removable handles 518 and 520 include handle extensions 532 and 534 respectively, each of which are sized to engage centerbore 530 and pass at least partially through centerbore 530. Although removable handles 518 and 520 are depicted as having handle extensions 532 and 534 for the purpose of affixing the pair of removable handles 518 and 520 to wheel assembly 502, any currently existing or later developed means may be used to attach removable handles 518 and 520 to wheel assembly 502. Thus, in another embodiment, removable handles 518 and 520 may lack handle extensions 532 and 534 but be outfitted with other types of fasteners.

Various pieces of fitness equipment can be stored within storage chamber 526, including but not limited to jump rope 536, set of sliders 538, and set of resistance bands 540. To make use of the limited amount of space within storage chamber 526, jump rope 536 is configured with telescopic handles that can extend when in use and collapse when stored. Set of resistance bands 540 can be folded and easily placed within storage chamber 526. Further, in this illustrative embodiment of FIG. 6, set of sliders 538 is adapted to fit within storage chamber 526, against removable covers 512 and 514. Set of sliders 538 may include a hole located in a position that permits the pair of removable handles 518 and 520 to be inserted into centerbore 530.

Figure 7:
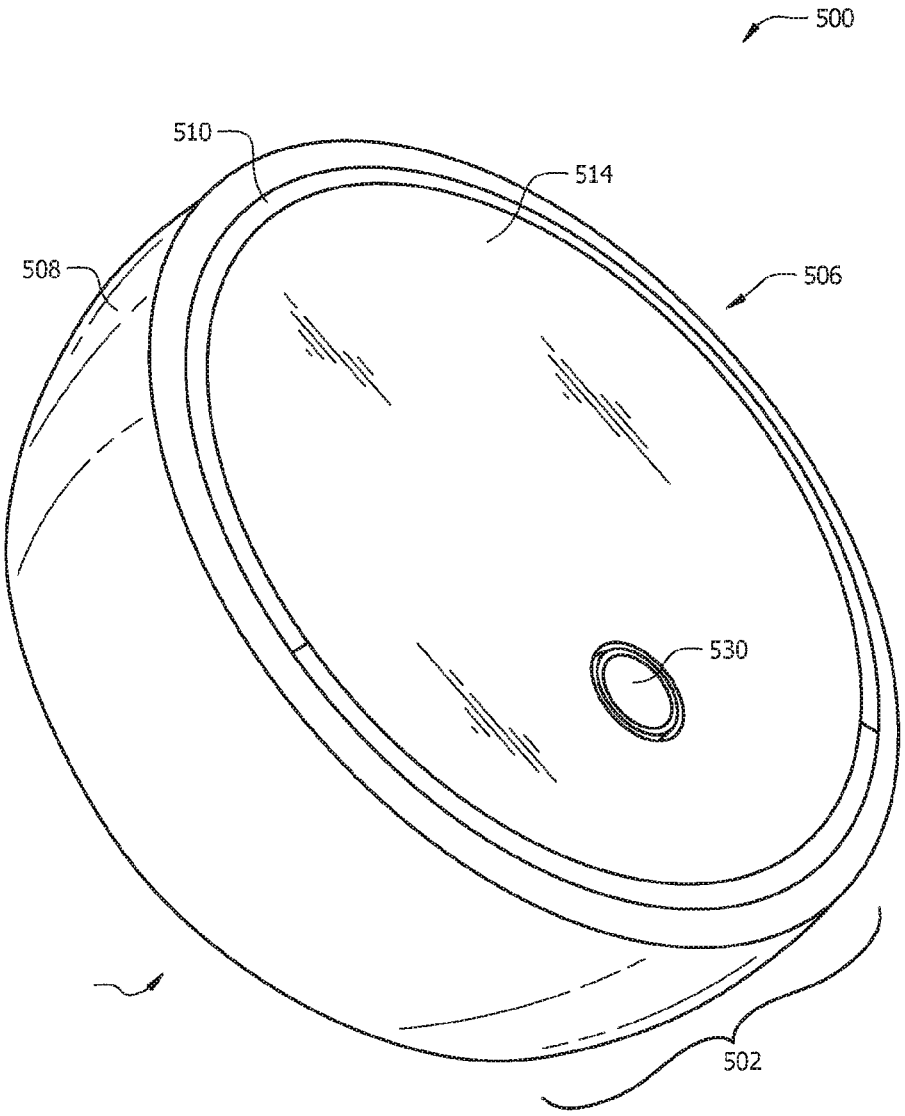
FIG. 7 is a perspective view of the fitness apparatus depicted in FIG. 5 in a storage configuration according to the second illustrative embodiment.

In an illustrative example, to transform fitness apparatus 500 from the abdominal wheel configuration to the storage configuration depicted in FIG. 7, each of the pair of removable handles 518 and 520 is removed from centerbore 530 of wheel assembly 502. If all pieces of fitness equipment have been previously extracted from storage chamber 526, then both removable covers 512 and 514 are disengaged from wheel assembly 502. A first slider in set of sliders 540 is placed against an interior surface of removable cover 512, and removable cover 512 is then reattached to first circular side 504 of wheel assembly 502.

Once removable cover 512 has been attached to first circular side 504 of wheel assembly 502, set of resistance bands 540 and jump rope 536 may be placed within the partially closed storage chamber 526 along with the pair of removable handles 518 and 520. The remaining slider in set of sliders 540 is placed over the opening of storage chamber 526, and removable cover 514 is affixed to the second circular side 506 of wheel assembly 502.

FIG. 7 is a perspective view of fitness apparatus 500 in a storage configuration according to the second illustrative embodiment. As with the illustration of fitness apparatus 500 in FIG. 5, fitness apparatus 500 in FIG. 7 depicts first circular side 504 opposite to and parallel with second circular side 506. Pair of removable handles 518 and 520 have been removed and placed within storage chamber 526 (not shown), along with one or more optional pieces of fitness equipment that may include a set of sliders, a set of resistance bands, and a jump rope. Removable cover 514 encloses storage chamber 526 and prevents the various pieces of fitness equipment from being separated and lost.

As previously discussed, centerbore 530 may form a channel that passes entirely through wheel assembly 502 from first circular side 504 to second circular side 506 along axis 516. Alternatively, centerbore 530 may take the form of a pair of cavities that passes only partially through each side of wheel assembly 502 with depths sufficient to receive handle extensions 532 and 534. Thus, with reference to FIG. 7, centerbore 530 may be a cavity with an opening at second circular side 506 which passes less than half-way through wheel assembly 502. Additionally, centerbore 530 may include another cavity with an opening at first circular side 504 which also passes less than half-way through wheel assembly 502.

In an illustrative example, to transform fitness apparatus 500 from the storage configuration depicted in FIG. 7 to the abdominal exercise wheel configuration depicted in FIG. 5, at least one removable cover is removed from wheel assembly 502 to expose storage chamber 526. Optionally, both removable covers may be removed from wheel assembly 502. Thereafter, the contents within storage chamber 526 are extracted. The user may then elect operate fitness apparatus 500 in the abdominal wheel configuration with the removable covers affixed to wheel assembly 502, or with the removable covers separate from wheel assembly 502. If the user elects to operate fitness apparatus 500 with the removable covers affixed to wheel assembly 502, then the user replaces one or both removable covers 512 and/or 514, making certain to align the holes in each of the respective removable covers with centerbore 530. The pair of removable handles 518 and 520 may then be attached to wheel assembly 502 by inserting handle extensions 532 and 534 into centerbore 530. If the user decides to operate fitness apparatus 500 with removable covers 512 and 514 separated from wheel assembly 502, then the user may remove the other removable cover if it was not previously removed, then the pair of handles 518 and 520 may be attached to wheel assembly 502 by inserting handle extensions 532 and 534 into centerbore 530.

Figure 8A:
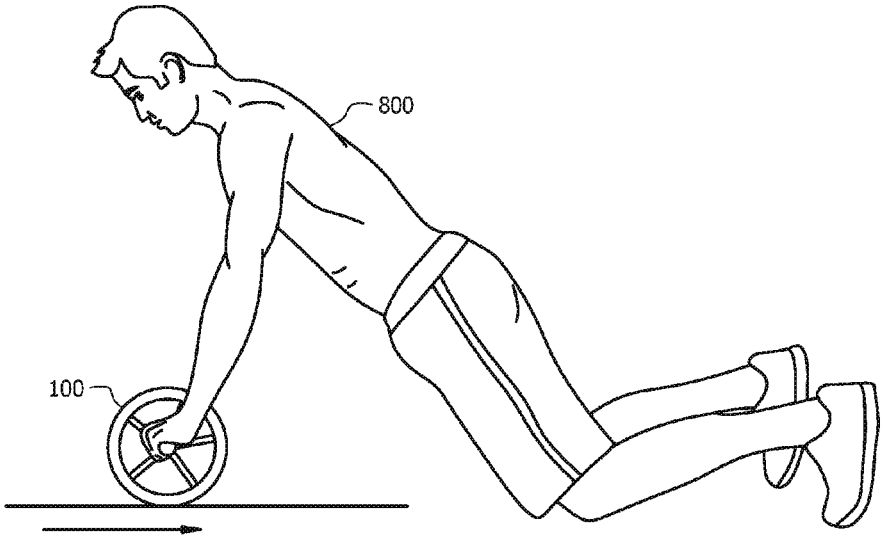
FIGS. 8*a* and 8*b* depicts a user operating fitness apparatus 100 in the abdominal exercise wheel configuration.
Figure 8B:
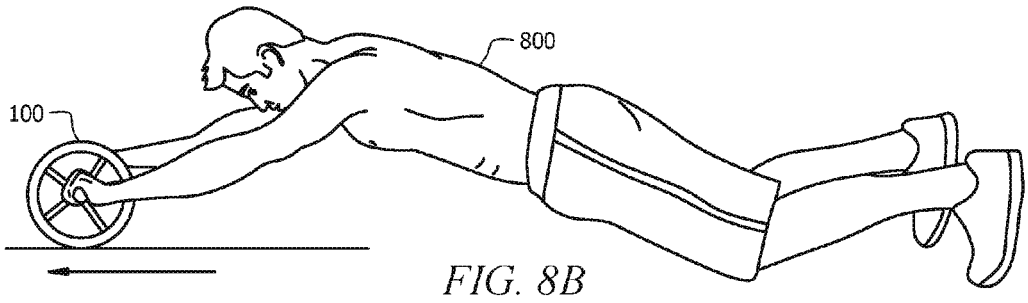

FIGS. 8*a* and 8*b* depicts a user operating fitness apparatus 100 in the abdominal exercise wheel configuration. FIG. 8*a* shows a user in a typical starting position. As can be seen, user 800 grasps handles 102 and 104, distributing weight between the knees of user 800 and fitness apparatus 100. While maintaining the position of the knees, user 800 allows fitness apparatus 100 to roll away until the extended position of FIG. 8*b* is achieved. User 800 then engages core muscles to withdraw fitness apparatus 100 to the starting position of FIG. 8*a*.

Figure 9:
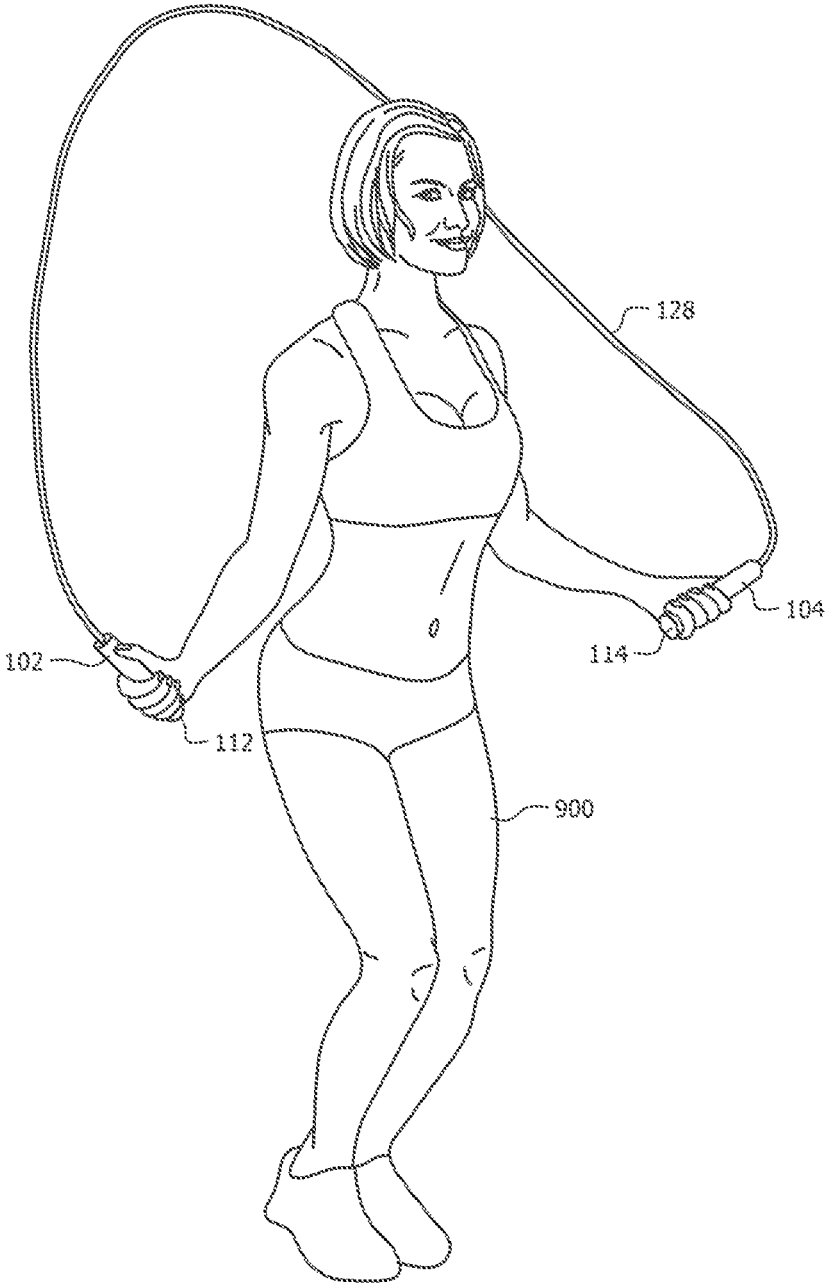
FIG. 9 is shows a user operating a fitness apparatus in the jump rope configuration according to an illustrative embodiment.

FIG. 9 shows a user operating fitness apparatus 100 in the jump rope configuration. As already described above, handles 102 and 104 are attached to the ends of rope 128 by means of locking discs 136 to form jump rope 400. By grasping handles 102 and 104, the user can cause jump rope 400 to rotate in a large arc. As the rope approaches the feet of user 900 during its revolution, user 900 jumps over the rope. The process is repeated to achieve an aerobic workout.

Figure 10:
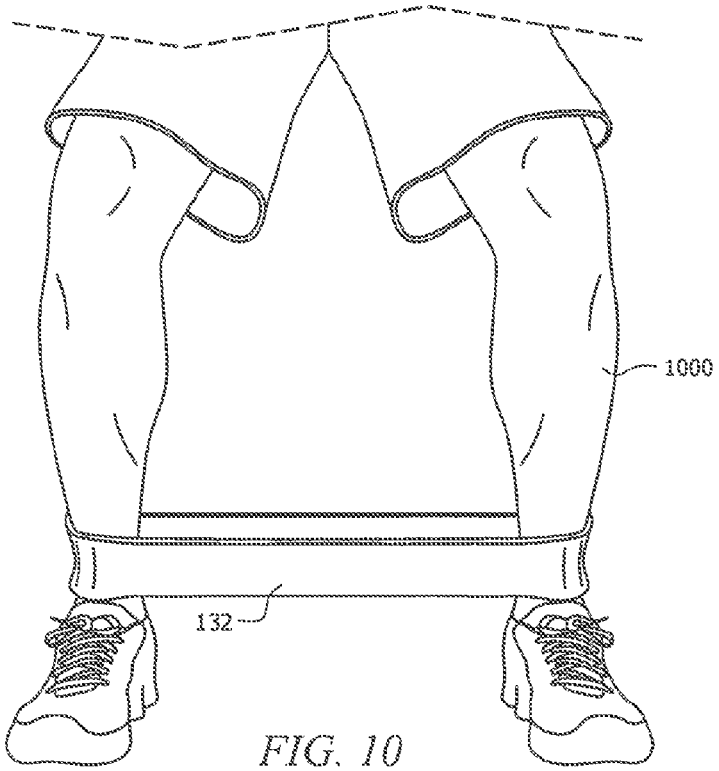
FIG. 10 depicts a user performing an exercise with the resistance bands in accordance with an illustrative embodiment.

FIG. 10 shows user 1000 using resistance band 132 according to one illustrative embodiment. In particular, user 1000 steps into resistance band 132 so that each leg engages opposite ends of resistance band 132. User 1000 can then perform a sidestep motion against resistance provided by resistance band 132. Although FIG. 10 depicts only one exercise, resistance band 132 may be used with any form of resistance-based exercise. For example, resistance band 132 may be looped around door handles to effectuate a modified rowing exercise, or grasped in each hand and pulled apart to exercise back and shoulder muscles.

Figure 11:
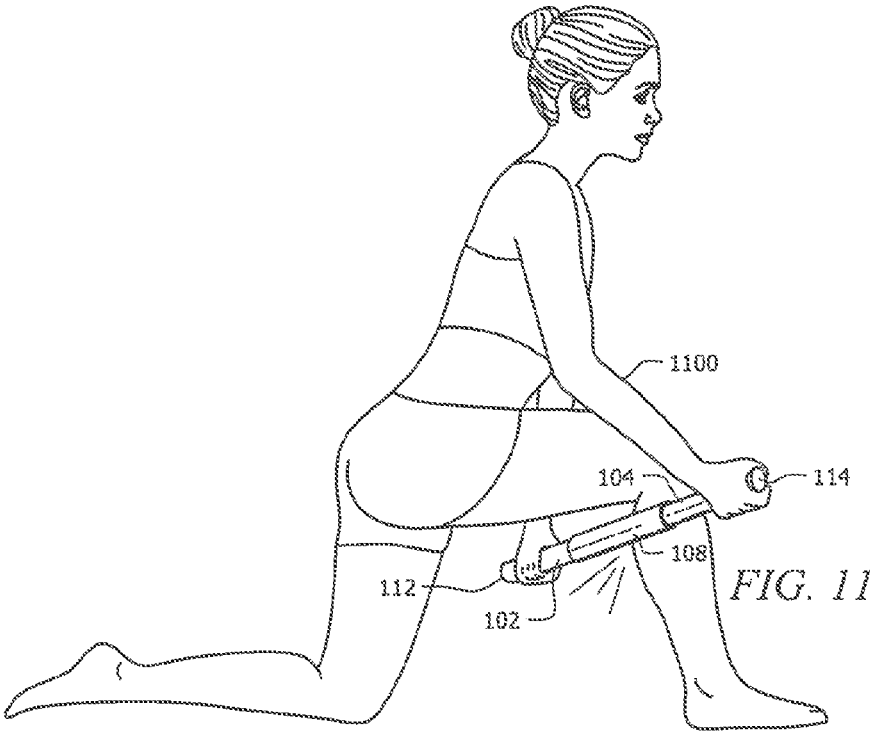
FIG. 11 depicts an embodiment of a user operating fitness apparatus in a massage bar configuration according to an illustrative embodiment.

FIG. 11 depicts user 1100 operating fitness apparatus 100 in the massage bar configuration. In particular, user 1100 grasps handles 102 and 104 and causes foam roller 108 to engage a calf muscle. The massage bar configuration of fitness apparatus 100 may be used to release tension and knots in any muscle or muscle group. Although in this illustrative embodiment, user 1100 is operating the massage bar to cause foam roller 108 to provide the massaging effects, in an alternate embodiment, user 1100 may cause the endcap affixed to one of the handles to engage a the body. The smaller point of contact permits a more focused effect.

Figure 12A:
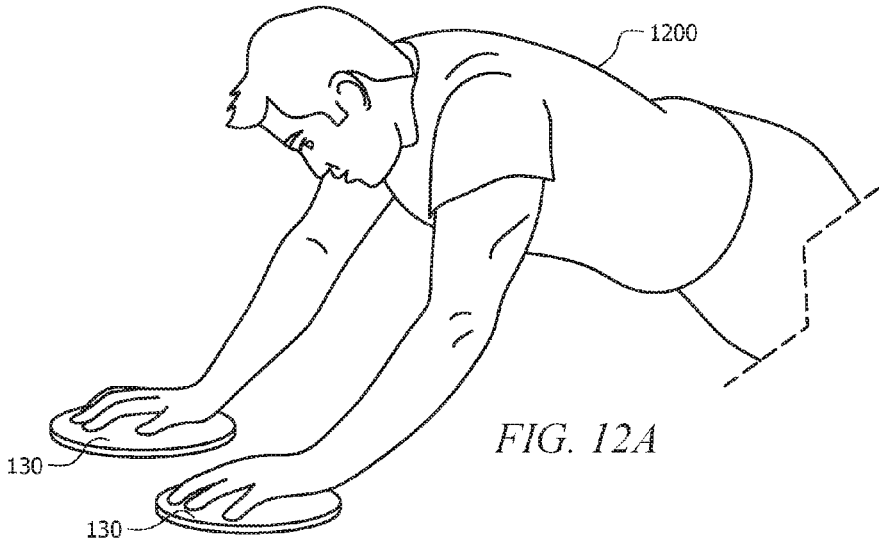
FIGS. 12*a* and 12*b* are illustrative examples of exercises that can be performed using the pair of sliders provided within a storage chamber of a fitness apparatus in accordance with an illustrative embodiment.
Figure 12B:
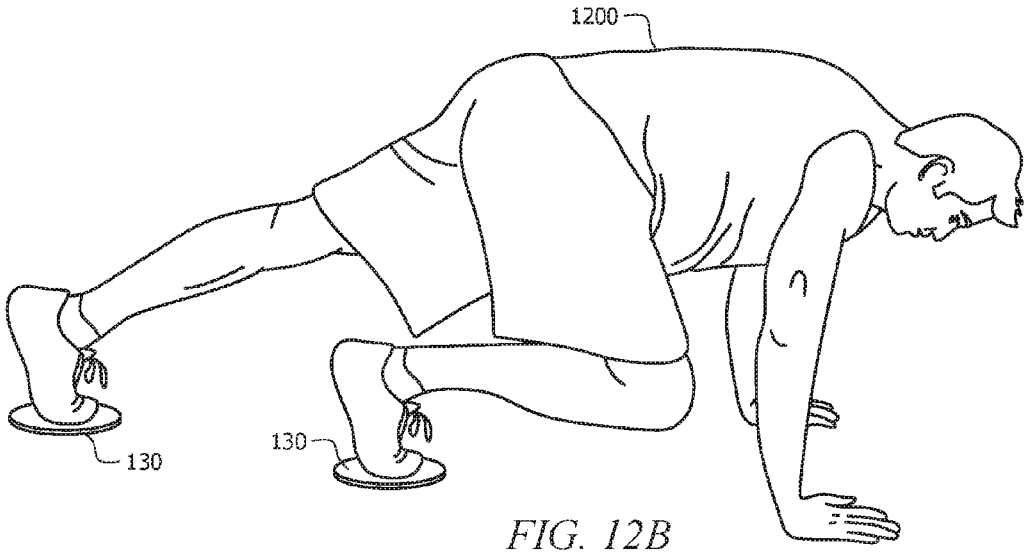

FIGS. 12*a* and 12*b* show alternative ways of exercising with the pair of sliders provided within the chamber of fitness apparatus 100. In the illustrative embodiment of FIG. 12*a*, user 1200 places one slider under the palm of each hand. The sliders reduce friction between a flooring surface, such as carpet or hardwood, and permits user 1200 to have at least two mobile points of contact, requiring exertion to produce a controlled movement. Similarly, in FIG. 12*b*, user 1200 places one slider under each foot for conducting another form of weight-based exercise.

Figure 13:
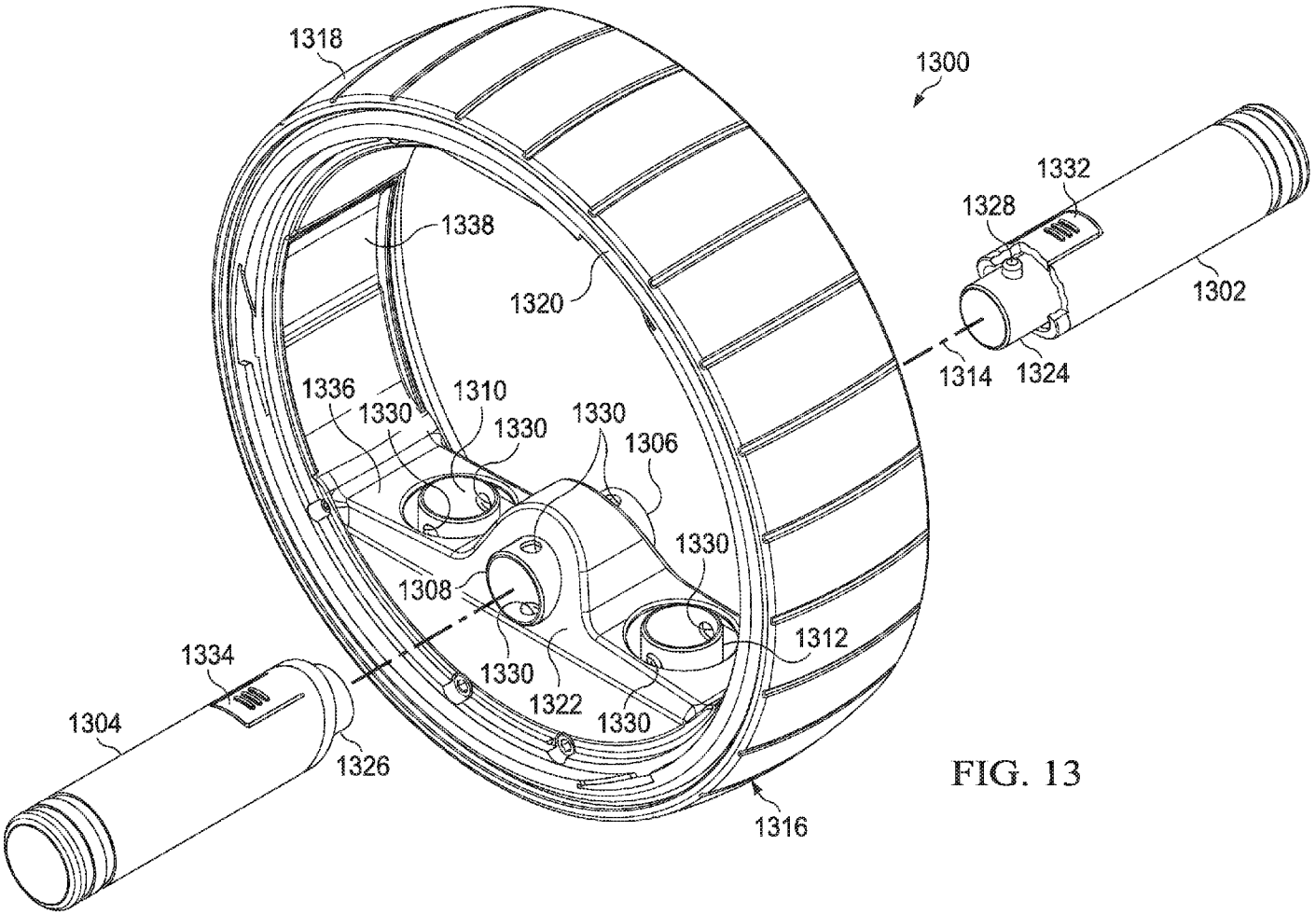
FIG. 13 is an expanded view of the fitness apparatus in accordance with a third illustrative embodiment.

FIG. 13 is an expanded view of a fitness apparatus in accordance with a third illustrative embodiment. Consistent one or more of the previously discussed embodiments, fitness apparatus 1300 can assume an abdominal exercise wheel configuration, such as the abdominal exercise wheel configuration shown and discussed in FIG. 5, or the storage configuration that is shown and discussed in FIG. 7. The fitness apparatus 1300 can assume the abdominal exercise wheel configuration by inserting each of the handles 1302 and 1304 into one of a set of axial handlebar connectors 1306 and 1308 along axis 1314. In the abdominal exercise wheel configuration, the fitness apparatus 1300 can be generally described as a wheel assembly 1316 having a curved tread surface 1318 rotatably engaged around rim 1320, the wheel assembly 1316 sandwiched between a pair of handles 1302 and 1304 extending outwardly from each circular side of the wheel assembly 1316 In one embodiment, removable circular covers may be attached to each circular side of the wheel assembly 1316 to hide the internal storage cavity, as shown in FIG. 5. The removable circular covers may have a first side that is softer than a second side so that the removable circular covers can be used as a pair of knee pads. For example, when in use, the harder side may be oriented downward to engage a workout surface and the softer side may be oriented upward to engage a user's knees. In the storage configuration, the harder side may face outward while the softer side may face inward.

Axial handlebar connectors 1306 and 1308 are connection devices maintained at least partially within the volume bounded by the interior surface of rim 1320 and each of the circular sides of the wheel assembly 1316. Axial handlebar connectors 1306 and 1308 are supported by a reinforced connection 1322 and configured to receive the terminal ends 1324 and 1326 of handles 1302 and 1304 to transform the fitness apparatus 1300 into the abdominal exercise wheel configuration. In this illustrative embodiment, axial handlebar connectors 1306 and 1308 are identically fashioned from opposing sides of a hollow cylindrical tube extending through the reinforced connection 1322, defining a centerbore that passes from one lateral side of the wheel assembly 1316 to the other lateral side. The exposed ends of each side of the cylindrical tube form axial handlebar connectors 1306 and 1308. In another embodiment axial handlebar connectors 1306 and 1308 are individual connection devices separate from one another and shaped as hollow cylindrical tubes, each of which is individually mounted to the reinforced connection 1322 and passing only partially through the reinforced connection 1322.

Figure 14:
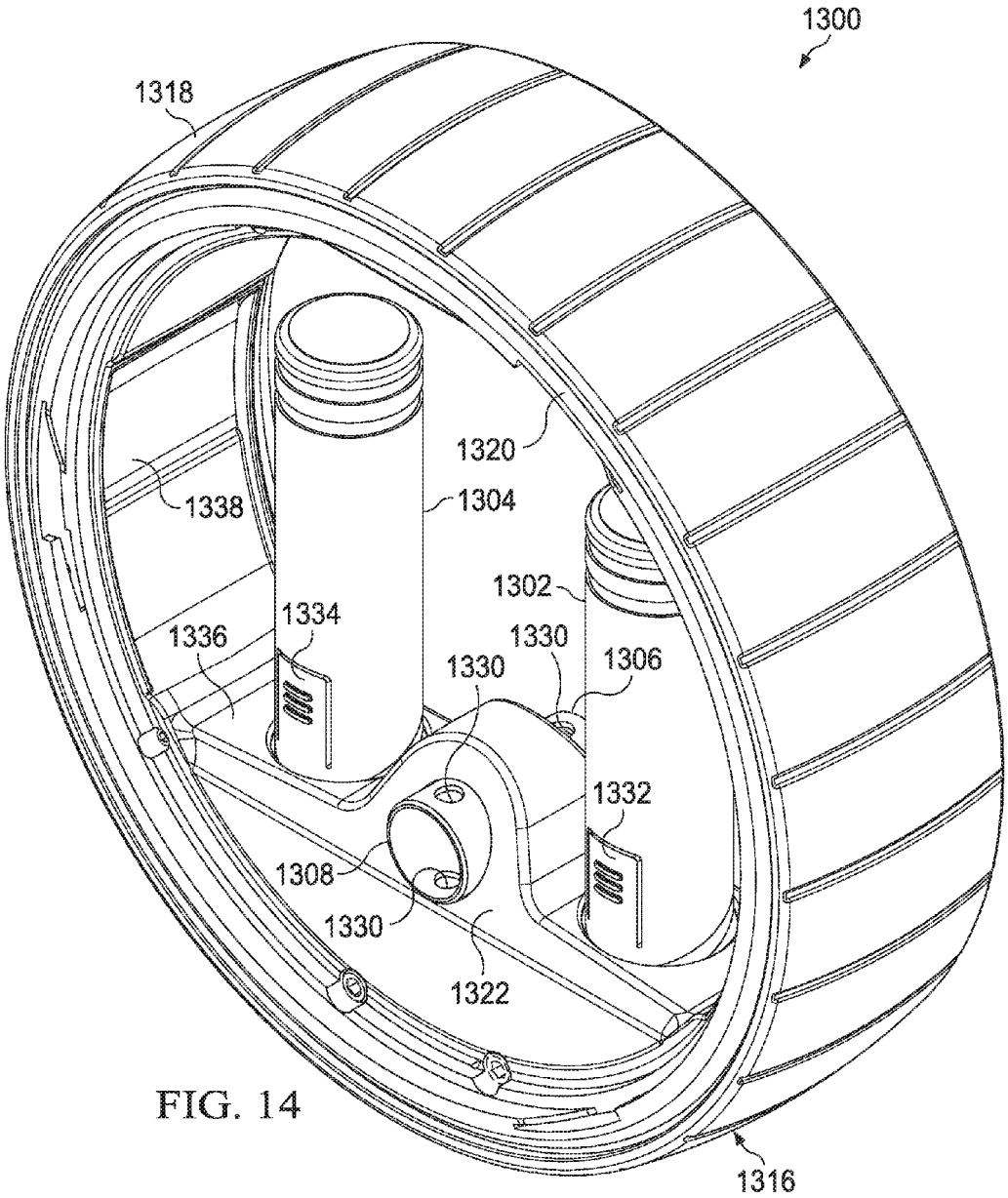
FIG. 14 is a perspective view of the fitness apparatus with handles attached to a pair of vertical handlebar connectors in accordance with an illustrative embodiment.

Fitness apparatus 1300 may also include a second pair of connection devices, vertical handlebar connectors 1310 and 1312, which are mounted to reinforced connection 1322 and also configured to receive the terminal end 1324 of handle 1302 and terminal end 1326 of handle 1304. Vertical handlebar connectors 1310 and 1312 are located within the volume bounded by the interior surface of rim 1320 and each of the circular sides of the wheel assembly 1316. In this manner, the handles 1302 and 1304 can be securely mounted within the storage cavity for transport, but which also permits the handles 1302 and 1304 to engage the wheel assembly 1316 in an alternate configuration that can permit a user to perform a wider variety of exercises. FIG. 14 depicts handles 1302 and 1304 engaged with vertical handlebar connectors 1310 and 1312. In a non-limiting embodiment, axial handlebar connectors 1306 and 1308 and vertical handlebar connectors 1310 and 1312 have identical form factors, but different orientations, so that each of terminal ends 1324 and 1326 can engage any one of the connectors 1306, 1308, 1310, and 1312.

To differentiate between the various handlebar connectors included within the fitness apparatus 1300, the handlebar connectors can be described as having different orientations relative to a particular fixed point of reference. For example, when the handlebar connectors are described relative to the lateral, circular sides of the wheel assembly 1316, axial handlebar connectors 1306 and 1308 can be described as having an orientation that is perpendicular and/or normal to the surface of each circular side because handles inserted into each of the axial handlebar connectors 1306 and 1308 extend perpendicularly from their respective circular side. Likewise, vertical handlebar connectors 1310 and 1312 can be described as having an orientation that is parallel to the first and second circular sides because handles inserted into vertical handlebar connectors 1310 and 1312 are oriented substantially parallel to each of these sides. In some embodiments, vertical handlebar connectors 1310 and 1312 may be angled to provide a more neutral grip. For example, vertical handlebar connectors 1310 and 1312 may be angled towards one of the circular sides so that handlebars inserted into the vertical handlebar connectors have unattached ends that are closer to one of the lateral sides than the other. Alternatively, the handlebar connectors may be oriented so that the unattached ends of the handlebars are equidistant to each of the lateral, circular sides but closer to each other.

In the illustrative embodiment in FIG. 13, the terminal ends 1324 and 1326 of their respective handles 1302 and 1304 can be joined with any one of the connectors 1306, 1308, 1310, and 1312 by sliding either of the terminal ends 1324 and 1326 into the hollow body of the connector. The handles are maintained securely within the connector by quick release pins 1328 extending from the interior of their respective terminal ends and protruding outwardly from the exterior surface of the terminal end to engage one or more eyelets located within each of the connectors 1306, 1308, 1310, and 1312. Eyelets are identified with reference numeral 1330.

Operation of the quick release pins are controlled by a pin controller, such as pin controllers 1332 and 1334 located on the body of handles 1302 and 1304. Depressing the pin controller causes the corresponding quick release pin to withdraw at least partially within the terminal end of the handle so that the terminal end of the handle can be easily inserted or extracted from a connector. A portion of handle 1302 has been cutaway to show the location of quick release pin 1328 on the terminal end 1324 of the handle 1302.

Although the eyelets 1330 have been described as a means to connect handles 1302 and 1304 with one of the set of connectors 1306, 1308, 1310, and 1312, the eyelets 1330 may be sized to engage with carabiners or any other metal hook or loop to connect the fitness apparatus 1300 to other fitness accessories, such as resistance bands.

In this illustrative embodiment in FIG. 13, handles 1302 and 1304 may be secured to one of connectors 1306, 1308, 1310, and 1312 by a quick release pin and corresponding eyelet. However, in alternate embodiments other fastening means may be implemented. For example, terminal ends 1324 and 1326 may have a cylindrical shape with a threaded surface configured to engage one of the set of handlebar connectors that are counter-threaded, which enables the handles 1302 and 1304 to be screwed into the handlebar connectors.

The reinforced connection 1322 of the wheel assembly 1316 is attached to or integrally formed with the interior surface of rim 1320. Additionally, the reinforced connection 1322 is shown as having an upper surface 1336 that can be generally described as two flat surfaces separated by an arcuate section, the flat surfaces oriented parallel to the ground when the fitness apparatus 1300 is being used in the abdominal wheel configuration. In one embodiment, the dimensions of the reinforced connection 1322 are dictated at least in part by the size of handles 1302 and 1304 so that the handles may be easily inserted and extracted from vertical handlebar connectors 1310 and 1312. For example, if the upper surface 1336 is arranged to pass through the geometric center of the wheel assembly 1316, then handles 1302 and 1304 would have insufficient clearance to engage the vertical handlebar connectors 1310 and 1312. Although upper surface 1336 is shown as a horizontal surface, in an alternate embodiment, the upper surface 1336 may be angled to take a more triangular configuration as shown in FIG. 5.

To accommodate users with larger hands, the interior surface of rim 1320 may be configured with a pair of concavities 1338 proximate to handles 1302 and 1304 when coupled with vertical handlebar connectors 1310 and 1312. In other embodiments, where the inside diameter of the rim 1320 is larger, the pair of concavities 1338 may not be necessary as there would be sufficient distance from the handles to the interior surface of the rim. However, increasing the interior diameter would result in a larger wheel assembly 1316, which could negatively affect the portability, usability, and storability of the apparatus.

FIG. 14 is a perspective view of the fitness apparatus 1300 with handles attached to a pair of vertical handlebar connectors in accordance with an illustrative embodiment. In this particular configuration, users can operate the fitness apparatus 1300 by grasping one or both handles and performing a variety of exercises. For example, one type of core exercise involves a user grasping both handles and distributing weight between the user's hands and knees and rolling the fitness apparatus back and forth in an arcuate path. Other forms of exercise may be achieved by attaching one or more resistance bands to an exposed eyelet 1330.

Figure 15A:
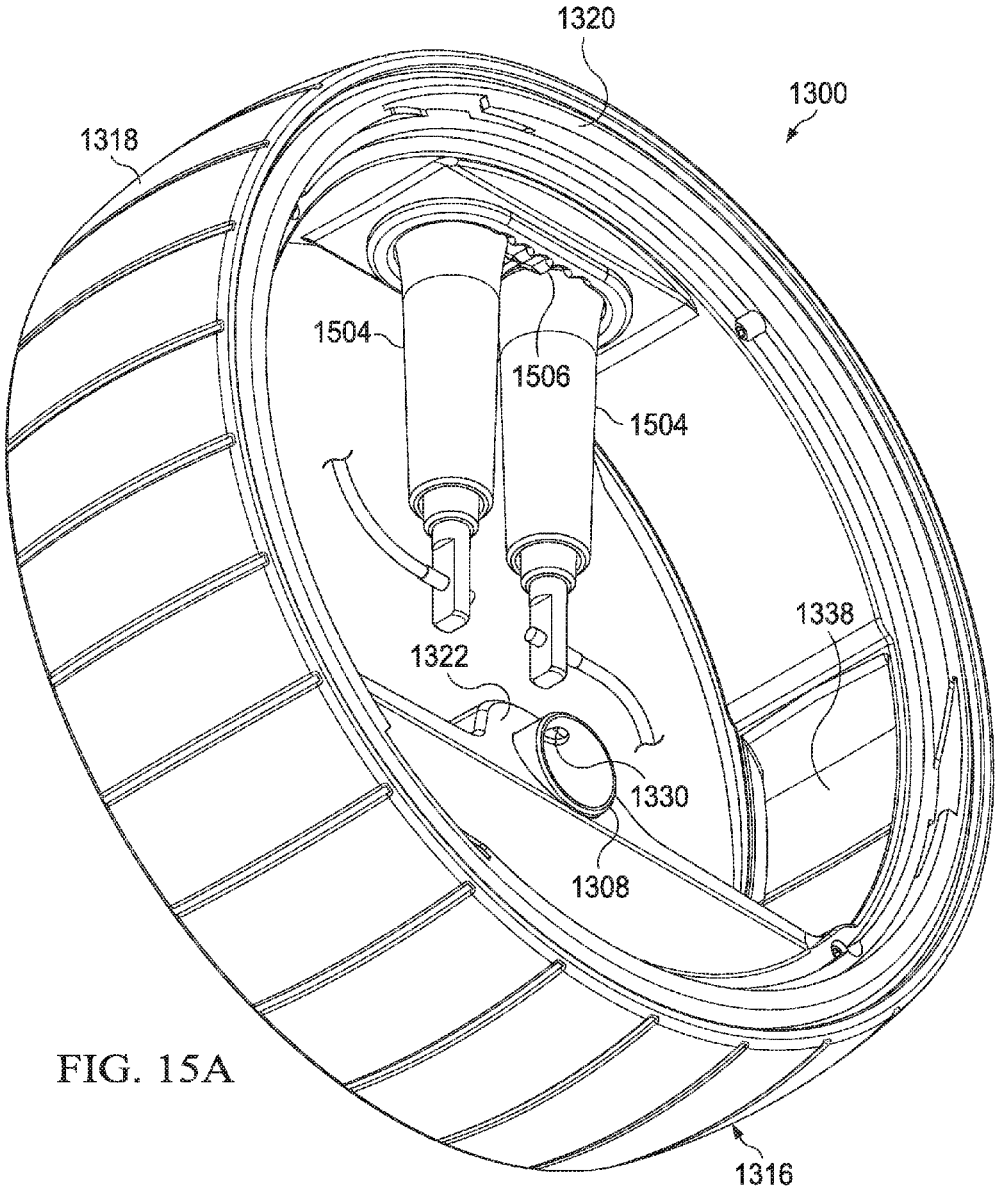
FIGS. 15*a* and 15*b* are perspective views of the fitness apparatus depicting a set of jump rope sockets in accordance with an illustrative embodiment.

Handles 1302 and 1304 may also be attached to vertical handlebar connectors 1310 and 1312 to achieve the configuration shown in FIG. 14 in preparation for storage. A pair of covers, such as the covers shown in FIG. 6 or 7, can be affixed to each of the circular sides of wheel assembly to form an enclosed storage cavity that houses the handles 1302 and 1304 and any other exercise equipment, such as a jump rope as shown in FIG. 15*a*. Resistance bands may also be stored within the enclosed storage cavity.

Figure 15B:
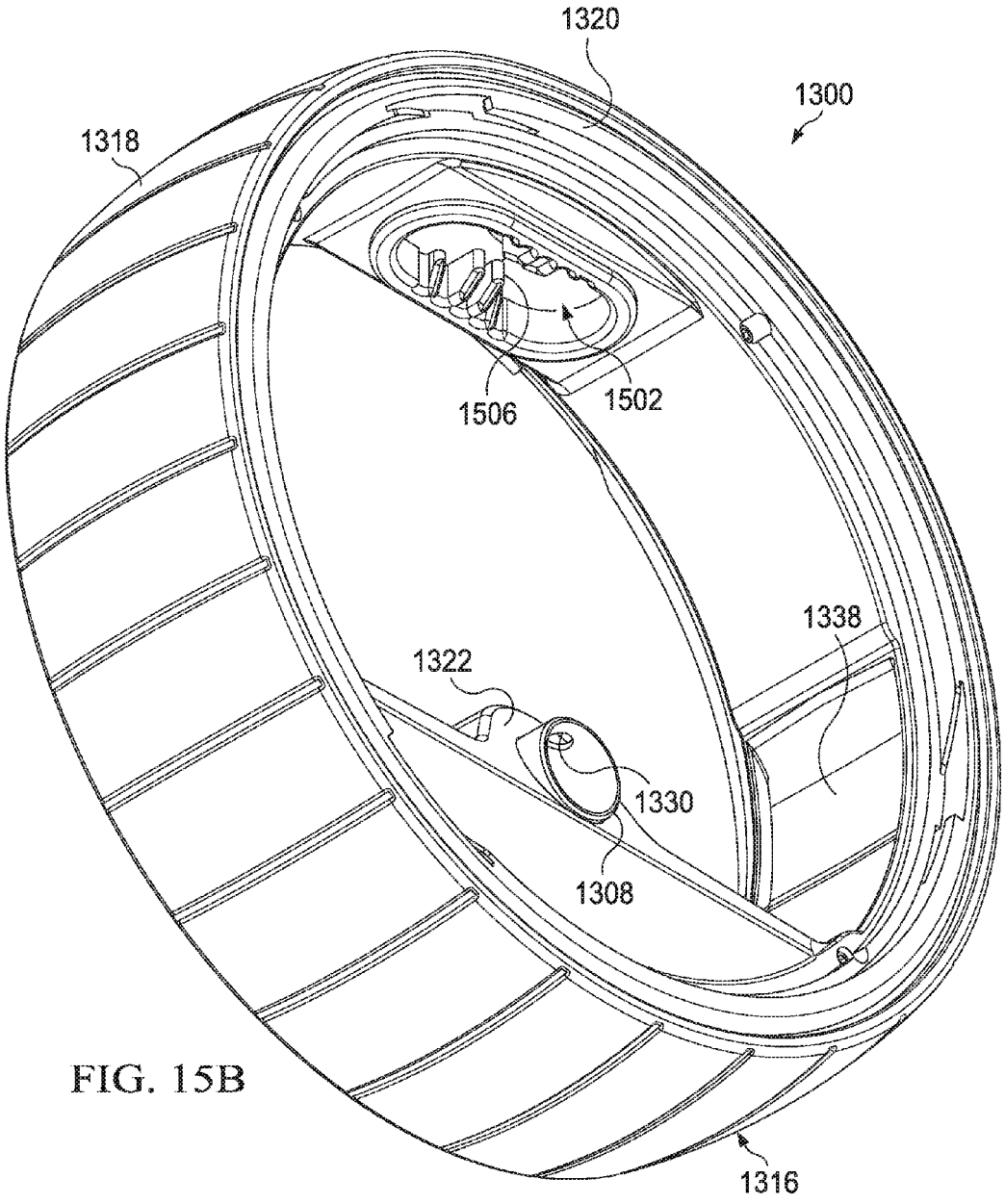

FIGS. 15*a* and 15*b* are perspective views of the fitness apparatus 1300 depicting a set of jump rope sockets in accordance with an illustrative embodiment. The set of jump rope sockets 1502 is a fastening device recessed within rim 1320 and can be generally described as one or more cavities, each of which generally has one closed end and one open end that leads into the volume bounded at least in part by the rim 1320. The closed end of the cavity and the open end is separated by one or more distinct sidewalls. For example, in the event that the set of jump rope sockets 1502 is a single cavity with a square shape, then the set of jump rope sockets 1502 will have four sidewalls. However, if the set of jump rope sockets 1502 has a cylindrical shape, then the set of jump rope sockets has only a single curved sidewall.

Set of jump rope sockets 1502 is sized to receive jump rope handles 1504 and is configured to secure a jump rope within the storage cavity when the fitness apparatus 1300 is in the storage configuration. In this illustrative embodiment in FIG. 15, jump rope handles 1504 are secured within the set of jump rope sockets 1502 by a plurality of flexible fins 1506 protruding perpendicularly from the sidewalls of the set of jump rope sockets 1502. The flexible fins 1506 frictionally engage the jump rope handles 1504. In alternate embodiments other forms of securing devices may be used. For example, the securing device may be mechanical or magnetic. Furthermore, although set of jump rope sockets 1502 has been depicted as a single cavity that is separated generally into two parts by the plurality of flexible fins 1506, in an alternate embodiment, the set of jump rope sockets 1502 may be two individual cavities.

While the invention has been particularly shown and described with reference to a preferred embodiment, it will be understood by those skilled in the art that various changes in form and detail may be made therein without departing from the spirit and scope of the invention.

What is claimed is:

1. A wheel assembly comprising:
a rim;
a curved tread surface rotatably engaged around the rim;
a reinforced connection engaged with an interior surface of the rim, wherein the reinforced connection houses a set of handlebar connectors; and
wherein the wheel assembly has a substantially cylindrical shape with a first circular side separated from a second circular side by the rim.

2. The wheel assembly of claim 1, wherein the set of handlebar connectors are vertical handlebar connectors oriented parallel to the first and second circular sides.

3. The wheel assembly of claim 1, wherein the set of handlebar connectors are axial handlebar connectors oriented perpendicularly to the first and second circular sides.

4. The wheel assembly of claim 1, wherein each of the set of handlebar connectors further comprises at least one eyelet.

5. The wheel assembly of claim 2, wherein the rim further comprises:
a concavity proximate to each of the set of vertical handlebar connectors.

6. The wheel assembly of claim 1, further comprising:
a set of sockets recessed within the rim.

7. The wheel assembly of claim 6, wherein the set of sockets further comprises:
one or more sidewalls;
a plurality of flexible fins extending perpendicularly from the one or more sidewalls.

8. The wheel assembly of claim 1, further comprising:
a pair of removable covers sized to engage each of the first and second circular sides to form an enclosed cavity bounded by the pair of removable covers and an interior surface of the rim.

9. The wheel assembly of claim 8, wherein the pair of removable covers has a first side and a second side, wherein the first side is softer than the second side.

10. A fitness apparatus comprising:
a pair of handles; and
a wheel assembly coupled with the pair of handles, wherein the wheel assembly further comprises:
a rim having a substantially cylindrical shape comprising a first circular side and a second circular side opposite and parallel to the first circular side;
a curved tread surface rotatably engaged around the rim; and
a reinforced connection engaged with an interior surface of the rim, wherein the reinforced connection houses a set of handlebar connectors.

11. The fitness apparatus of claim 10, wherein the set of handlebar connectors are vertical handlebar connectors oriented parallel to the first and second circular sides.

12. The fitness apparatus of claim 10, wherein the set of handlebar connectors are axial handlebar connectors oriented perpendicularly to the first and second circular sides.

13. The fitness apparatus of claim 10, wherein each of the set of handlebar connectors further comprises at least one eyelet.

14. The fitness apparatus of claim 13, further comprising:
a carabiner coupled to the eyelet; and
a resistance band attached to the carabiner.

15. The fitness apparatus of claim 11, wherein the rim comprises a concavity proximate to each of the vertical handlebar connectors.

16. The fitness apparatus of claim 10, further comprising:
a set of sockets recessed within the rim.

17. The fitness apparatus of claim 16, wherein the set of sockets further comprises:
one or more sidewalls; and
a plurality of flexible fins extending perpendicularly from the one or more sidewalls.

18. The fitness apparatus of claim 10, further comprising:
a pair of removable covers sized to engage each of the first and second circular sides to form an enclosed cavity bounded by the pair of removable covers and an interior surface of the rim.

19. The fitness apparatus of claim 18, wherein the pair of removable covers has a first side and a second side, wherein the first side is softer than the second side.

* * * * *